United States Patent [19]

Chodosh

[11] 4,269,334

[45] May 26, 1981

[54] PRINTING AND PLEATING

[75] Inventor: Edward Chodosh, London, England

[73] Assignee: Roldwest Limited, London, England

[21] Appl. No.: 22,508

[22] Filed: Mar. 21, 1979

[30] Foreign Application Priority Data

| | | | |
|---|---|---|---|
| Mar. 22, 1978 | [GB] | United Kingdom | 11518/78 |
| Dec. 12, 1978 | [GB] | United Kingdom | 48152/78 |
| Dec. 22, 1978 | [GB] | United Kingdom | 49828/78 |

[51] Int. Cl.[3] ..... D06P 3/24; A41H 33/00

[52] U.S. Cl. ..... 223/28; 8/470; 223/37

[58] Field of Search ..... 223/28, 37; 270/1, 4; 8/2.5 R, 2.5 A

[56] References Cited

U.S. PATENT DOCUMENTS

| | | | |
|---|---|---|---|
| 1,729,347 | 9/1929 | Kirschenbaum | 8/2.5 R |
| 1,825,342 | 9/1931 | Dreyfus et al. | 8/2.5 R |
| 2,632,495 | 3/1953 | Agee | 223/28 X |
| 2,645,856 | 7/1953 | Eyster | 223/28 X |
| 2,821,237 | 1/1958 | Howard | 223/28 |
| 3,874,846 | 4/1975 | Ashe | 8/2.5 R |
| 4,181,497 | 1/1980 | Buckwalter et al. | 8/2.5 R |

*Primary Examiner*—Louis Rimrodt

*Attorney, Agent, or Firm*—Browdy & Neimark

[57] ABSTRACT

There is provided a method of printing and pleating a fabric which comprises folding the fabric into a pleat pattern and then simultaneously forming the pleat and printing the fabric by passing the fabric together with a print paper in contact with at least a portion thereof through a zone heated to a temperature sufficient to cause the print color and/or pattern to be transferred to the fabric while the folds in the fabric are simultaneously made into permanent pleats.

17 Claims, 1 Drawing Figure

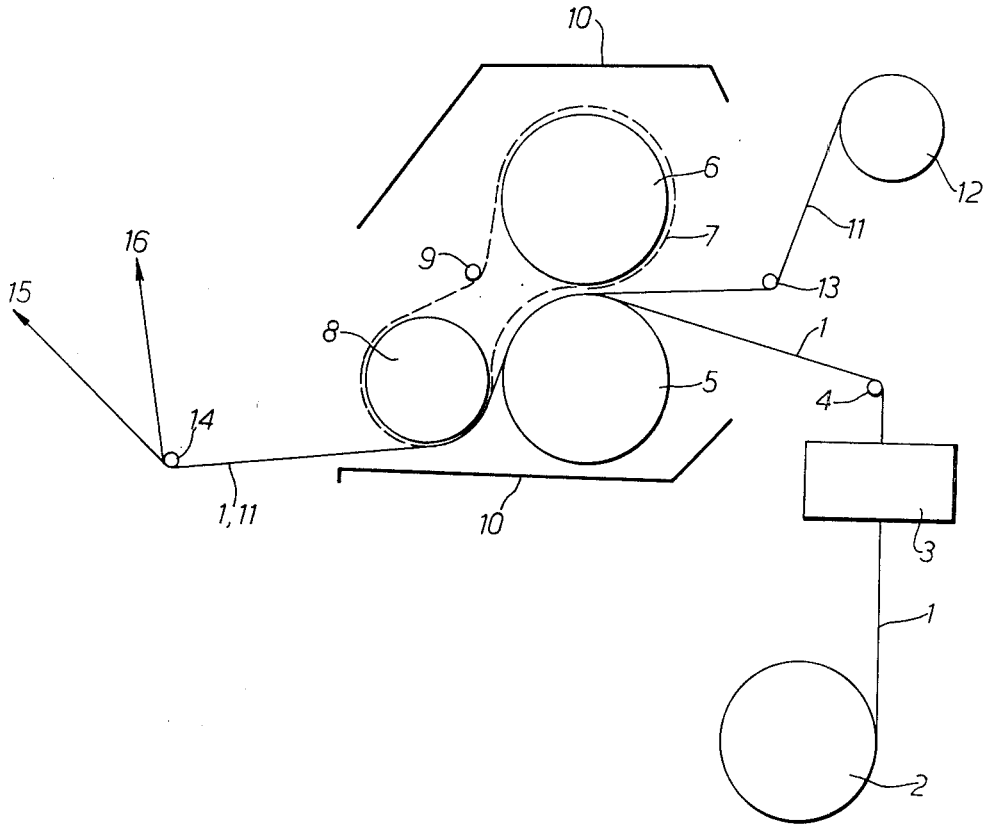
10
6
12
7
11
16
9
13
15
8
1
5
4
14
1,11
10
3
1
2

PRINTING AND PLEATING

BACKGROUND OF THE INVENTION

This invention relates to print pleating, i.e. the production of pleated fabric having a printed pattern applied to portions of the fabric. In one embodiment, the finished effect is that a colour and/or pattern is or are applied only to those portions of the fabric which are visible when the pleats are closed. In another embodiment, the print is applied only to the edges of the pleat.

Conventionally, a fabric is first pleated on a pleating machine and is subsequently passed through a printing machine to obtain the desired printed, pleated fabric. Difficulties are experienced, however, in passing a pleated fabric through a printing machine. For effective printing, it is essential that the pleated material remains with the pleats in the closed configuration. Any opening of the pleats or additional folding of the pleated fabric results in an unsatisfactory print being obtained, which may mean that a large quantity of fabric has to be rejected.

SUMMARY OF THE INVENTION

I have now found that it is possible to produce pleats and to print a pattern onto the pleated fabric in a single machine, thus obviating the need to transfer the pleated fabric from the pleating machine to a printing machine. More particularly, the present invention provides a method of printing and pleating a fabric which comprises folding the fabric into a pleat pattern and then simultaneously forming the pleat and printing the fabric by passing the fabric together with a print paper in contact with at least a portion thereof through a zone heated to a temperature sufficient to cause the print colour and/or pattern to be transferred to the fabric while the folds in the fabric are simultaneously made into permanent pleats. The invention also provides fabrics printed and pleated by the method of the invention. Most frequently, the print paper will contact the top surface of the fabric so that the two materials are like parallel layers in contact with one another. However, it is not essential to operate the method in this way. Instead, the fabric can be folded in a manner such that it can be compressed in the manner of a concertina, and the print paper can contact only the edges or "tips" of the folds. By operating in this manner, the method of the present invention gives rise to the so-called tip-printing.

DESCRIPTION THE PREFERRED EMBODIMENTS

Preferably, the fabric and the print paper are passed together between a pair of opposed rollers at least one of which is heated. Advantageously, the roller which contacts the print paper is heated to a higher temperature than the roller which contacts the fabric. It is sometimes desirable for direct contact to occur between the roller surfaces and the fabric and print paper, i.e. there is no sleeve or 'heat blanket' covering the contact surfaces of either of the rollers. Alternatively, a sleeve may be used around that roller which contacts the print paper (usually the top roller), but the sleeve should be formed of a material with a higher degree of resistance to heat than is conventionally employed. Such a sleeve is preferably able to withstand temperatures as high as 275° F. without damage.

Where tip-printing is to be effected, the heated zone can take the form of an autoclave or oven. Tip-printing is effective where the fabric has been folded to give knife pleats, crystal pleats, accordian pleats, crush mushroom pleats and open end crystal pleats.

The print applied to the fabric may consist, for example, of a single solid or broken colour, or may be a pattern of several colours. Complicated patterns containing many different colours can be produced as easily as simple patterns.

The print paper may be pre-heated before it comes into contact with the folded fabric. Heating can be applied by suitable means, for example along a length of 6 to 7 inches immediately ahead of the fabric/print paper contact zone. This assists in ensuring a complete and clean transfer of the print onto the fabric.

The print paper can be fed to the fabric contact zone by any convenient arrangement. One arrangement which is generally suitable involves mounting a roll of print paper on a spring-loaded bar so that the print paper comes off the roll under slight tension. The print paper then passes under two rods which act as guides, and which direct the print paper towards the fabric contact zone. Where the heated zone is formed by a pair of opposed rollers, the feed angle of the print paper is preferably such that the print paper makes contact with a sleeve which surrounds one of the rollers before it contacts the fabric. A tangential feed onto the sleeve of one of the rollers is advantageous because it helps to make the print paper lie snugly on the sleeve or roller (usually the top roller).

We have found that the above method can be carried out on a normal pleating machine to which certain modifications have been made. Firstly, it is necessary in order to achieve satisfactory transfer of the print from the print from the print paper to the fabric to employ temperatures which are higher than those normally used to render pleats permanent. It must be realised, however, that the temperatures to which the fabric is subjected must be controlled so as to prevent damage to the fabric itself. In a conventional roller-type pleating machine, the pleated fabric is passed between a top roller and a bottom roller, both of which are heated to a temperature of approximately 150° to 200° F. in order to make the pleats permanent. The top roller is usually located in a sleeve or heat blanket which passes around the lower part of the top roller and runs between the top roller and a floating roller disposed behind the top roller. In the method of the present invention, the heat blanket and floating roller are not essential and so they can be dispensed with, or retained, at will; preferably, the print paper passes between the rollers on top of the fabric, and the top roller is modified so as to produce a higher temperature, preferably in the region of 450° F. The bottom roller is preferably heated to approximately 300° F., this arrangement being sufficient to ensure that the fabric is simultaneously printed and the folds in the fabric rendered into permanent pleats. This can be achieved, for example, by modifying the arrangement of the heating elements with conventional heated rollers. The roller-type pleating machine is advantageously provided with a heat-resistant box which covers the top rollers and which, in use, serves to conserve heat within the area of the top roller.

The print paper can be mounted above the pleating machine on free running rollers and can then be brought down into contact with a revolving roller positioned so as to deflect the print paper towards the nip between the top and bottom rollers. The print paper preferably does not come into contact with the top and bottom rollers except at the nip unless it contacts the sleeve or heat blanket prior to coming into contact with the rollers. The folded fabric, as shown in the Figure 1 may contact the bottom roller before the print paper is brought into contact with the folded fabric. The contact between the print paper and the top roller (which is preferably at 450° F.) is sufficient to transfer the print from the paper onto the upper surface of the pleated fabric which is simultaneously passing through the nip between the top and bottom rollers. The heat provided by the bottom roller together with the heat coming through the print paper from the top roller is sufficient to form the folds in the fabric into permanent pleats. The fabric issuing from the machine is thus printed on the exposed areas of the closed pleats only, and is permanently pleated.

The bottom roller is advantageously fixed, while the top roller is urged against the bottom roller by biassing means adapted to produce a suitable pressure, generally of approximately 100 lbs/sq. inch.

The free running roller which acts as a guide roller for the print paper can conveniently be a silver steel rod of 1 inch diameter. This rod may take the place of the top forming assembly plate in a conventional pleating machine.

The rate at which the fabric and print paper are passed between the heated rollers depends upon the nature and finish of the fabric being treated. In order to achieve best results in any given case, it may be necessary to test a number of samples of fabric at different rates throughput and at different roller temperatures.

For tip-printing, an oven or autoclave-type pleating machine can be modified to carry out the method of the invention. In conventional machines, the fabric is wound using a rolling-up paper before passing to an autoclave which heats the fabric to a temperature sufficient to make the pleats permanent. In the method of the present invention, conventional rolling-up paper can be supplied on top of the print paper, so that the fabric is wound so that the fabric and print paper are sandwiched between a lower paper layer and an upper, rolling-up paper layer. The fabric can then be heated or autoclaved in this condition to produce the desired tip-printed fabric.

The accompanying drawing schematically illustrates one embodiment of the invention. Referring to the drawing, fabric 1 is fed from a roll supply 2 through a folding arrangement 3 in which the fabric is folded in a predetermined pattern corresponding to the type of pleat which is to be formed in the fabric. Such folding arrangements are known per se. The fabric 1 leaves folding arrangement 3 and contacts a roller 4. This deflects the fabric towards that part of the apparatus which simultaneously forms permanent pleats in the fabric and prints the surface of the fabric. This part of the apparatus comprises a fixed lower roller 5 against which an upper roller 6 is urged by biassing means (not shown) adapted to produce a pressure of about 100 lbs per square inch. A heat blanket 7 (not essential) passes around most of the upper roller 6 and also passes around a floating roller 8 which is positioned adjacent to, and at about the same horizontal level as, the lower roller 5. A tensioning roller 9 is provided to prevent the heat blanket 7 becoming unncessarily loose. A heat box 10 is provided around the assembly of rollers 5, 6, 8 and 9 in order to conserve heat, particularly in the vicinity of upper roller 6.

A print paper 11 is fed from a free running roller 12 to a small steel roller 13 which is positioned facing the nip between rollers 5 and 6. In operation, print paper 11 passes from roller 13 into the nip between rollers 5 and 6 where it contacts the folded fabric coming from roller 4. The fabric and print paper pass in contact with one another around an upper surface portion of lower roller 5, and around a lower surface portion of floating roller 8. Subsequently, the fabric and print paper pass to a small roller 14 at which they are separated to give the finished, print-pleated fabric 15 and used print paper 16.

Heating elements (not shown) are provided in the interior of upper roller 6 and are operated so that the surface of roller 6 is at a temperature of approximately 450° F. (232° C.). The lower roller 5 also has internal heating elements (not shown) which are operated so as to provide a surface temperature of approximately 300° F. (149° C.). These conditions combined with the pressure applied to the print paper 11 and fabric 1 at the nip between rollers 5 and 6 are sufficient to cause transfer of the dye material from print paper 11 onto the surface of the folded fabric 1, while simultaneously forming the folds of the fabric 1 into permanent pleats. The conditions are not so severe as to cause to damage to the fabric. As previously indicated, the rate at which the fabric and print paper are passed between heated rollers 5 and 6 depends upon the nature and finish of the fabric being treated. In some cases, minor modifications of the temperatures employed may also be required in order to give optimum results. It may therefore be advisable to test a number of small samples of fabric at different rates of throughput and at different roller temperatures before commencing a long run with the apparatus.

With the arrangement just described, the finished effect is that a colour or a pattern of one or more colours is applied only to those portions of the pleated fabric which are visible when the pleats are in their closed condition. Where the print paper comprises a solid colour only, the finished print-pleated fabric will comprise two colours, the first being the ground colour of the fabric itself and the second being the colour applied by the print paper. When the folds of the fabric are closed, only the latter colour will be visible. If the folds are partially or fully opened, however, both colours appear. Similarly, if a pattern of several colours is applied from the print paper, the pattern appears continuous when the folds of the fabric are closed, but becomes broken or discontinuous when the folds are opened.

What is claimed is:

1. A method of printing and pleating a fabric which comprises folding the fabric into a pleat pattern and then simultaneously forming the pleat and printing the fabric by passing the fabric together with a print paper in contact with at least a portion thereof through a zone heated to a temperature sufficient to cause the print colour and/or pattern to be transferred to the fabric while the folds in the fabric are simultaneously made into permanent pleats.

2. A method according to claim 1, wherein the fabric and print paper are passed between a pair of opposed rollers at least one of which is heated to a temperature sufficient to effect the simultaneous printing and pleating.

3. A method according to claim 2, wherein the roller which contacts the print paper is heated to a higher temperature than that which contacts the fabric.

4. A method according to claim 3, wherein there is direct contact between the roller surfaces and the fabric on the one hand and the print paper on the other hand.

5. A method according to claim 4, wherein the print paper passes between the rollers on top of the fabric.

6. A method according to claim 5, wherein the top roller is heated to a temperature of approximately 450° F.

7. A method according to claim 6, wherein the bottom roller is heated to a temperature of approximately 300° F.

8. A method according to claim 1, wherein the top roller is urged against the bottom roller by biassing means.

9. A method according to claim 8, wherein said biassing means produce a pressure of approximately 100 lbs per square inch.

10. A method according to claim 1, wherein the heated zone consists of an oven or an autoclave.

11. A method according to claim 10, wherein the fabric is folded and compressed in the manner of a concertina while the print paper contacts the exposed edges of the folded fabric.

12. A method of printing and pleating a fabric which comprises folding the fabric into a pleat pattern and then simultaneously forming the pleat and printing the fabric by passing the fabric together with a print paper in contact with at least a portion thereof between a pair of opposed rollers, with the print paper on top of the fabric, at least one of which rollers is heated to a temperature sufficient to cause the print colour and/or pattern to be transferred to the fabric while the folds in the fabric are simultaneously made into permanent pleats.

13. A method according to claim 12, wherein the top roller is heated to a temperature of approximately 450° F.; the bottom roller is heated to a temperature of approximately 300° F.; and the top roller is biassed against the bottom roller to provide a pressure of about 100 lbs. per square inch.

14. A method of printing and pleating a fabric which comprises folding the fabric into a pleat pattern and then simultaneously forming the pleat and printing the fabric by passing the fabric together with a print paper in contact with at least a portion thereof through a zone heated to a temperature sufficient to cause the print colour and/or pattern to be transferred to the fabric while the folds in the fabric are simultaneously made into permanent pleats, wherein the fabric is folded and compressed in the manner of a concertina while the print paper contacts the exposed edges of the fabric, and wherein the fabric and print paper are passed through an oven or autoclave which constitutes said heated zone.

15. A method of printing and pleating a non-thermoplastic fabric, which comprises folding the fabric into a pleat pattern; placing a print paper in contact with at least a portion of the folded fabric; and then simultaneously forming the pleats and printing the fabric by passing the folded fabric and the print paper between a pair of opposed heated rollers, the roller adjacent to the print paper being heated to a temperature of approximately 450° F. and the roller adjacent to the folded fabric being heated to a temperature of approximately 300° F.

16. A method according to claim 15, wherein, after said folding of said fabric into a pleat pattern and before said print paper is placed in contact with said folded fabric, said folded fabric is passed into contact with the surface of one of said pair of opposed heated rollers.

17. Apparatus for the printing and pleating of a non-thermoplastic fabric, comprising:

folding means for continuously feeding a web of the fabric;

folding means for continuously folding into a pleat pattern the fabric received from the feeding means;

means for continuously feeding a print transfer paper;

means for bringing the print transfer paper into facial contact with at least a portion of the folded fabric and for simultaneously forming the pleats and printing the fabric, said means comprising a pair of opposed heated rollers between which the folded fabric and print paper are passed; and means to heat the roller adjacent the print paper to a temperature of approximately 450° F., and means to heat the roller adjacent the folded fabric to a temperature of approximately 300° F.

* * * * *